US005203688A

United States Patent [19]

Dietiker

[11] Patent Number: 5,203,688

[45] Date of Patent: Apr. 20, 1993

[54] SAFE GAS CONTROL VALVE FOR USE WITH STANDING PILOT

[75] Inventor: Paul Dietiker, Redondo Beach, Calif.

[73] Assignee: Honeywell Inc., Minneapolis, Minn.

[21] Appl. No.: 831,116

[22] Filed: Feb. 4, 1992

[51] Int. Cl.[5] ..... F23D 14/72

[52] U.S. Cl. ..... 431/51; 137/66; 251/67; 251/100; 431/57; 431/84

[58] Field of Search ..... 431/51, 84, 57, 52, 431/60, 72, 83; 137/66; 251/67, 68, 74, 100

[56] References Cited

U.S. PATENT DOCUMENTS

| | | | |
|---|---|---|---|
| 2,258,811 | 10/1941 | Ray | 251/68 X |
| 2,363,073 | 11/1944 | Mantz | 137/66 |
| 2,885,606 | 5/1959 | Clements . | |
| 3,045,690 | 7/1962 | Nickells | 137/66 |
| 3,480,028 | 11/1969 | van der Zee . | |
| 3,572,355 | 3/1971 | Van der Linden . | |
| 3,574,308 | 4/1971 | Battersby . | |
| 3,682,188 | 8/1972 | Randolph et al. . | |
| 3,877,475 | 4/1975 | Dietiker . | |
| 4,442,853 | 4/1984 | Gort . | |
| 4,543,974 | 10/1985 | Dietiker et al. . | |
| 4,729,396 | 3/1988 | Kelly et al. | 137/868 X |
| 4,802,841 | 2/1989 | Komura et al. . | |

*Primary Examiner*—Stephen M. Hepperle
*Attorney, Agent, or Firm*—Charles L. Rubow

[57] ABSTRACT

A fuel gas control valve capable of internationally acceptable operation, including a main valve operable in an on-off mode by an electromagnetic actuator that receives a signal from a conventional electric thermostat. A pilot valve is initially operated by a manual control, and is retained in the operating position by a power unit responsive to sensed presence of a pilot flame. A latching mechanism associated with the manual control interrelates with the main valve and overrides operation of the electromagnetic actuator in the event the pilot flame is extinguished for any reason. The valve also includes a mechanism that retains the manual control in pilot position until the pilot flame is established.

15 Claims, 3 Drawing Sheets

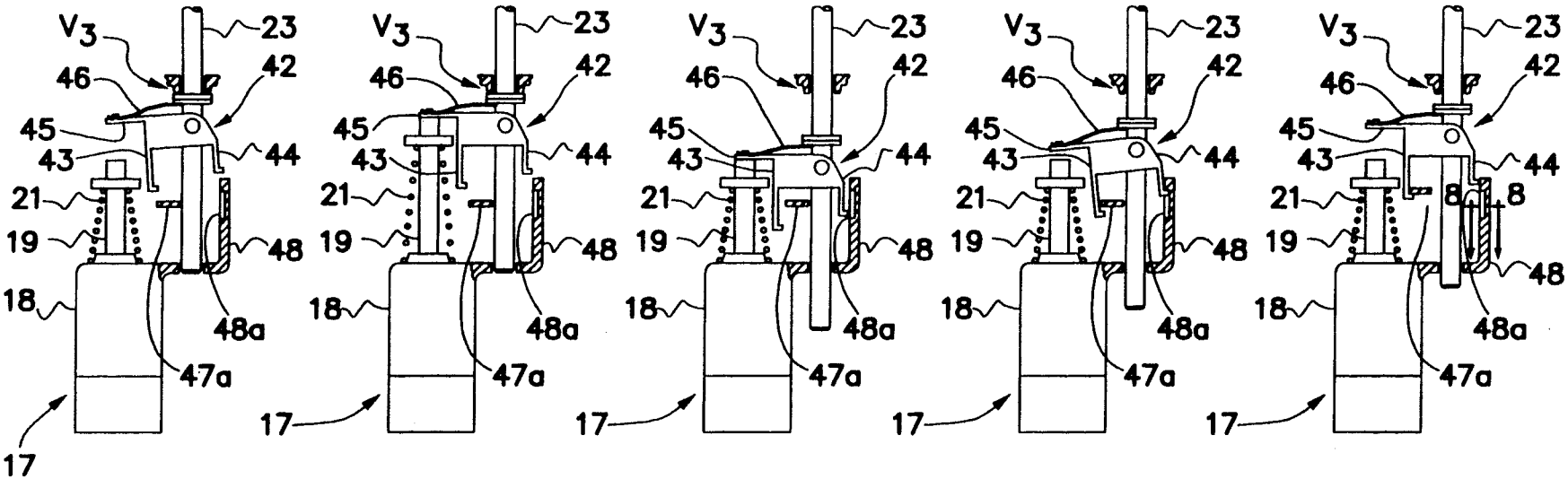
Fig.3
Fig.4
Fig.5
Fig.6
Fig.7
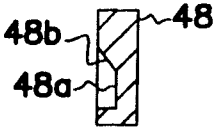
Fig.8

SAFE GAS CONTROL VALVE FOR USE WITH STANDING PILOT

BACKGROUND OF THE INVENTION

The invention broadly relates to control valves, and more specifically to a safe fuel gas valve of a type which, after ignition of a standing pilot burner, permits operation only when the pilot flame is present.

U.S. Pat. No. 4,543,974, which issued on Oct. 1, 1985, and is commonly owned with the present patent application, discloses a gas control valve for use with a standing pilot, the valve operating on an on-off basis by an electromagnetic actuator which responds to a conventional electric thermostat. A pilot valve is manually opened to permit a pilot burner to be lit, and an inlet safety valve for the device permits the flow of gas to the pilot valve and main valve only when the pilot flame exists. There is no functional relationship between the safety valve and main valve, and the electromagnetic actuator is capable of opening and closing the main valve whether or not the safety valve is open.

U.S. Pat. No. 3,973,576, which issued on Apr. 10, 1976 and is commonly owned with the present application, discloses a gas valve having a safety valve opened by a mechanism that is actuated only if a pilot flame is established. This feature, which provides "super safe" operation, prevents the valve from being turned off and then back on before it has been safely reset. Such a "super safe" function is a requirement in many European countries.

SUMMARY OF THE INVENTION

The present invention combines the advantageous features respectively embodied in the valves of U.S. Pat. Nos. 3,973,576 and 4,543,974, and results in a control valve for a gas appliance that causes the thermostatically controlled on-off valve to also act as a safety valve by including means that override the on-off operation when the pilot flame is extinguished for any reason.

The inventive valve also includes an improvement to the "super safe" mechanism that causes a manual control to be retained in a pilot position without the need for continued manual depression of the control knob. In so doing, the valve uniquely complies with standards now applicable in the United States of America.

As a result, the inventive valve not only provides for an improved combination of functions, but also provides a single valve which satisfies applicable requirements of both the United States and Europe.

BRIEF DESCRIPTION OF THE DRAWINGS

FIGS. 3–7 are partial sectional views of a portion of the gas valve of FIG. 1 showing a latching mechanism therein in various operating states; and FIG. 8 is an enlarged sectional view taken along the line 8—8 of FIG. 7 showing the configuration of a latching notch having a ramp surface for releasing a cooperating latch member.

DESCRIPTION OF THE PREFERRED EMBODIMENT

Figure 1:
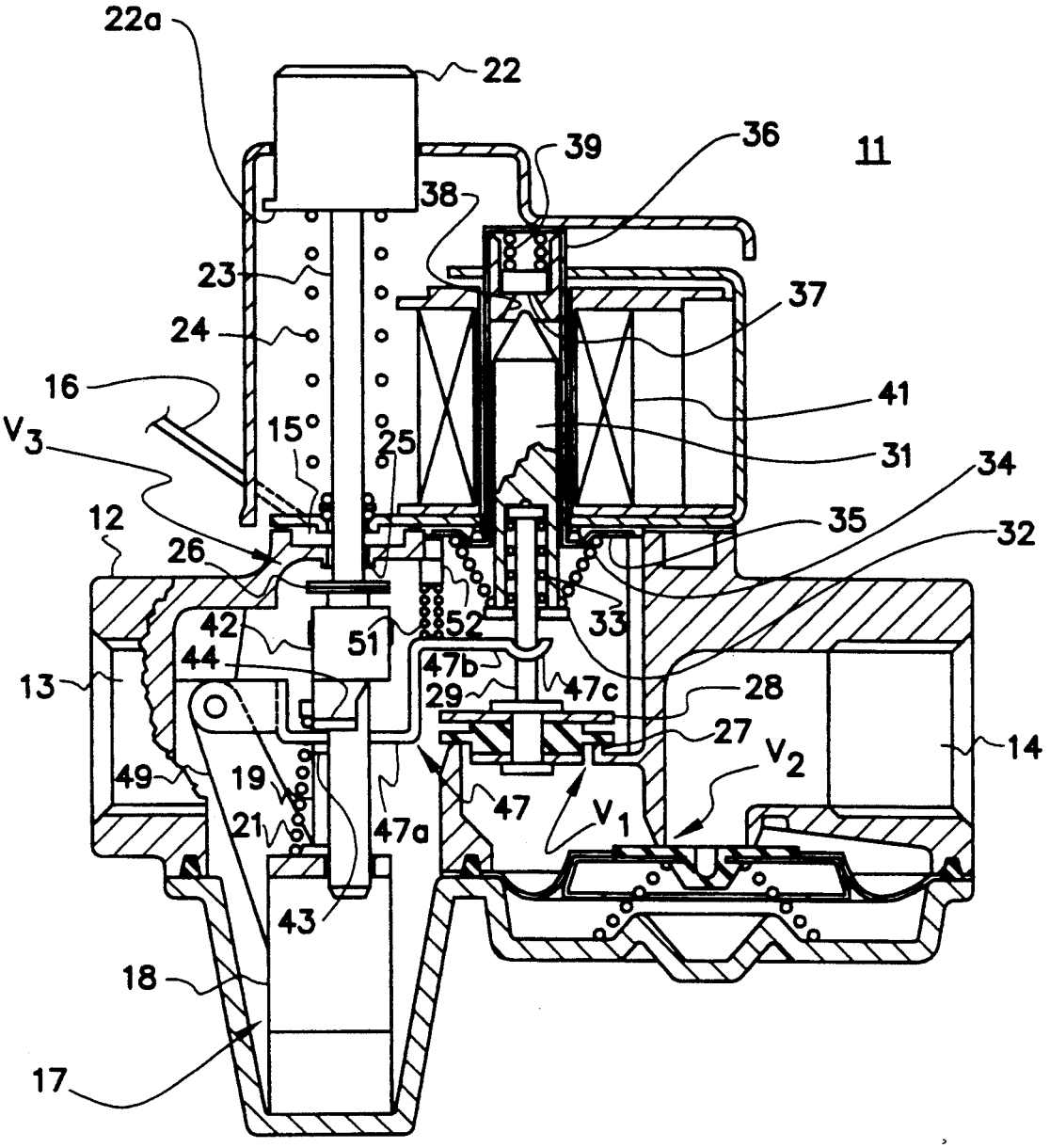
FIG. 1 is a sectional view of a gas valve embodying the applicant's invention.

With initial reference to FIG. 1, a gas valve embodying the invention is generally identified by reference numeral 11. Valve 11 includes a housing 12 defining an inlet 13 adapted for connection to a source of natural or l.p. gas and an outlet 14 adapted for connection to a gas appliance, such as a furnace or boiler.

Between the inlet 13 and outlet 14, a pair of valves $V_1$ and $V_2$ are arranged in series. As is apparent, both of valves $V_1$ and $V_2$ must be open for gas to be delivered through the outlet 14 to an appliance, and closure of either valve member will interrupt the flow of gas. A valve $V_3$, the components of which will be discussed in detail hereinafter communicates with a pilot chamber 15 and pilot passage 16, the latter of which is adapted for connection to a standing pilot burner in the appliance.

With reference to FIGS. 1 and 3–7, a power unit 17 mounted in housing 12 comprises a solenoid 18 including solenoid plunger 19 normally biased to an extended position, as illustrated in FIG. 4, by a conical spring 21. Solenoid 18 is actuated by a remote thermocouple (not shown) disposed to be adjacent the pilot flame. In the presence of the pilot flame, solenoid 18 is energized, retracting plunger 19 against the bias of spring 21 to the position shown in FIGS. 1, 3 and 5–7.

With continued reference to FIGS. 1 and 3–8, a manual control knob 22 projects externally of the housing 12, and is mounted on a vertical shaft 23 that is mounted for both rotation and axial reciprocation in the housing 12. Knob 22 and shaft 23 are urged upwardly by a coil spring 24, although knob 22 is shown in a depressed position in FIG. 1. As shown in FIGS. 3–7, shaft 23 is disposed in parallel relationship to plunger 19 of power unit 17, but is offset relative thereto.

With specific reference to FIG. 1, an annular valve seat 25 defined by housing 12 encircles shaft 23, and a valve closure member 26 is mounted on shaft 23 for sealing operation with seat 25. The members 25, 26 together comprise pilot valve $V_3$, which is shown in an open state in FIGS. 1 and 5–7 with knob 22 and shaft 23 in corresponding depressed positions.

Valve $V_1$ comprises an annular valve seat 27 defined within the housing 12 and a closure member 28 mounted at the lower end of a valve stem 29. The upper end of valve stem 29 is received in an end bore or receptacle in a lower end of a plunger 31. The lower end of plunger 31 includes a stop 32 in the form of a transverse pin. A coil spring 33 encircles valve stem 29, and is disposed in compression between the upper end of the stem and stop 32. A conical spring 34 encircles the lower end of plunger 31, and is disposed between a retainer 35 and stop 32 to normally urge the plunger downwardly.

Plunger 31 is slidable within a tubular core member 36. Its upper end, which is pointed, is engagable with a resilient block 37 held within plunger stop 38 and biased downward by a coil spring 39. Resilient block 37 absorbs noise when a solenoid or electromagnetic actuator 41, of which plunger 31 is a part, is energized, and plunger 31 snaps upwardly.

In the deenergized state of solenoid 41, plunger 31 is extended to the position shown in FIG. 1 by spring 34, which closes valve $V_1$. Solenoid 41 is energized by an "on" signal from a remote thermostat (or other controller), indicating the demand for heat. When energized, solenoid 41 retracts plunger 31 against the bias of spring 34. Whether or not this results in opening of valve $V_1$ depends on the condition of other components as discussed hereinafter.

Valve $V_2$ is a conventional pressure operated valve which can be controlled from a pressure regulator and an electrically controlled pilot valve of the type show in U.S. Pat. No. 3,354,901 which issued on Nov. 28, 1967.

With reference to FIGS. 1 and 3–8, a tilting latch member 42 is pivotally mounted to shaft 23, and is structurally and functionally similar to the tilting latch member disclosed in above identified U.S. Pat. No. 3,973,576. Latch member 42 includes downwardly extending latch legs 43, 44, both of which perform latching functions as described below.

Latch member 42 has a tail portion 45 that is engageable with the upper end of plunger 19 when knob 22 and shaft 23 are rotated to the proper position. A leaf spring 46 acts between seating member 26 and tail portion 45 to bias latch member 42 counter clockwise as viewed in FIGS. 3–7. It will be notes that, when extended, plunger 19 may engage tail portion 45 and move latch member 42 to its upright or non-latching position against the bias of spring 46 (see FIG. 4). Latching member 42 may also be moved into engagement with retracted plunger 19 as shaft 23 is moved downwardly (see FIG. 5), which rotate member 42 to a non-latching position.

With reference to FIG. 7, a lever 47 is disposed to be latchably engaged by latch leg 43 in one operational state, as described hereinafter. With reference to FIG. 6, an L-shaped bracket 48 on power unit 17 extends upwardly in a parallel but offset relationship to shaft 23. It includes a recess or notch **48*a* on its inner surface, as will be described in greater detail hereinafter, that is latchably engageable by latch leg 44** in a certain operational state described hereinafter.

With reference to FIG. 1, lever 47 is shown to extend generally horizontally, with one end pivotally connected to a bracket 49. A lower intermediate portion **47*a* of lever 47 is positioned for selective engagement with latch leg 43, as previously noted. A coil spring 51 is disposed in compression between an upper intermediate portion 47*b* of lever 47 and a spring retainer 52**.

When lever 47 is not engaged by latch leg 43, spring 51 urges the lever downwardly, with the extreme end **47*c* engaging closure member 28 to close valve $V_1$. Even if solenoid 41 is activated at this time to retract plunger 31, lever 47 is adapted to maintain valve closure member 28 in the closed position against the biases of springs 33, 34. If lever 47 is engaged by latch leg 43, as illustrated in FIGS. 1 and 7, the extreme end 47*c* is moved upwardly against the bias of spring 51 away from closure member 28. In this position of lever 47, valve $V_1$ will open if solenoid 41 is energized and will close if solenoid 41 is deenergized. Pilot valve $V_3$ is also open with lever 47 in the latched position of FIGS. 1 and 7**.

Figure 2:
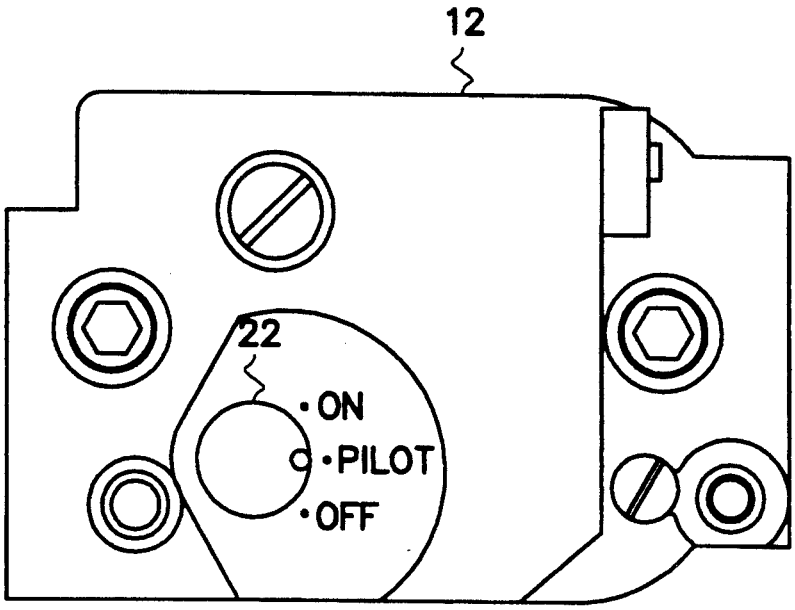
FIG. 2 is a top view of the gas valve of FIG. 1.
Figure 2A:
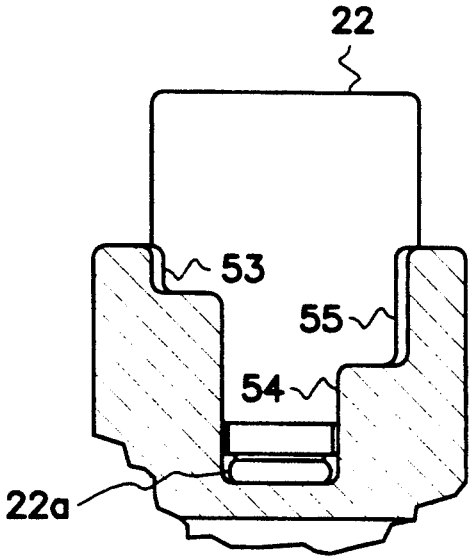
FIG. 2A is an enlarged partial sectional view of a control knob and interrelating structure of the gas valve of FIG. 1.

With continued reference to FIGS. 1, 2 and 2A, knob 22 may be rotated in a counter clockwise direction from an "off" position to a "pilot" position, and further to an "on" position (see FIG. 2). As shown in FIGS. 1 and 2A, knob 22 has a lateral extension **22*a* that interrelates with three vertically oriented adjacent guide channels 53–55 of differing depths formed in housing 12 (see FIG. 2A). The channels limit both axial and rotational movement of the knob 22, and hence limit shaft 23 in the same respect. Channel 53 corresponds to the "off" position, which prevents knob 22 from being depressed, but which permits counter clockwise rotation. Channel 54 corresponds to the "pilot" position, which permits knob 22 to be depressed as shown in FIG. 2A, but which permits rotational movement in the depressed position. Channel 55 corresponds to the "on" position, which permits knob 22** to be depressed to a limited extend, and permits limited clockwise movement in this depressed position.

Operation of the valve 11 will be described relative to FIGS. 3–7. Initially assuming that knob 22 is in the "off" position and that the gas appliance has been inoperative for a period of time, valve 11 will be in the state shown in FIG. 4. Power unit 17 is deenergized because the remote pilot therocouple is cool, and plunger 19 is extended by conical spring 21. In this position, the upper end of plunger 19 engages tail portion 45 of the tilting latch member 42, causing it to rotate to the non-latching position shown in FIG. 4. In this position, both of the legs 43, 44 are free from engagement with cooperative latching components, and knob 22 and shaft 23 may be depressed as discussed below.

With reference to FIG. 4, pilot valve $V_3$ is off because spring 24 (see FIG. 1) urges knob 22 and shaft 23 to their uppermost positions. Also, in this state latch leg 43 does not engage lever 47, and spring 51 urges lever 47 to its lower position to close valve $V_1$, whether or not solenoid 41 is energized. With no pilot flame, valve $V_1$ cannot be opened even in the presence of a demand from the thermostat or other controller connected to solenoid 41.

To initiate operation of the gas valve 11 and the associated appliance, the pilot burner must first be lit. This is accomplished by rotating knob 22 to the "pilot" position and depressing knob 22 to the position shown in FIGS. 2A and 5, with the lateral extension **22*a* of knob 22 extending to the lowest portion 54 of the channel. In this position, valve $V_3$ is open, admitting gas into pilot passage 16** and permitting the pilot burner to be lit either manually or automatically.

As shown in FIG. 5, with knob 22 and shaft 23 depressed to the "pilot" position, tail portion 45 continues to engage the upper end of plunger 19, and tilting latch member 42 remains in its upright or nonlatching position.

When the pilot flame has been established for a sufficient period of time, the remote pilot therocouple (not shown) energizes solenoid 18 or power unit 17 to maintain plunger 19 in its retracted position. At this point, knob 22 may be released. As shaft 23 is moved upwardly by spring 24, tail portion 45 becomes disengaged from the upper end of plunger 19, and leaf spring 46 rotates latch member 42 in a counter clockwise direction to the latching position shown in FIG. 6. In this position the foot of latch leg 44 enters the notch **48*a*, and shaft 23 is thus retained in a corresponding depressed position so long as knob 22 is in the "pilot" position. In this state (see FIG. 1**), pilot valve $V_3$ remains open to maintain the pilot flame, but valves $V_1$ and $V_2$ remain closed as before.

In the position shown in FIG. 6, and with additional reference to FIG. 1, shaft 23 has been raised by spring 24 until the foot of latch leg 44 reaches the upper edge of notch **48*a*. In this position, and with momentary reference to FIG. 2A, the lateral extension 22*a* of knob 22 has been raised in channel 54 to the base of channel 55. Knob 22 may thereafter be rotated counter clockwise to the "on" position, enabling latch 44 to rotate laterally out of the notch 48***a*. With reference to FIG. 8, this is implemented by ramp surface 48*b* defining one side of the notch 48*a*, which permits latch leg 44 to slide out of notch 48*a* and into engagement with the inner surface of bracket 48.

With continued reference to FIGS. 1 and 7, as soon as latch leg 44 leaves notch 48*a*, spring 24 urges knob 22 and shaft 23 upwardly. As this occurs, and as shown particularly in FIG. 7, the foot of latch leg 43 engages the underside of lever 47. Under the influence of spring 24, knob 22 and shaft 23 continue to move upwardly, and, correspondingly, lever 47 is moved upwardly so that the lever end 47*c* becomes disengaged from valve closure member 28. Such upward movement of lever 47 is resisted by spring 51, and lever 47 comes to rest in the position shown in FIG. 1. In this position, safety valve $V_1$ may now be opened when a demand signal is supplied to solenoid 41 from the remote thermostat (or other controller). This is the condition of normal "on" operation of valve 11, with valve $V_1$ operating between open and closed positions as a function of demand.

It will also be noted in FIGS. 1 and 7 that pilot valve $V_3$ remains open to continue the flow of gas through pilot passage 16 to maintain the pilot flame, which in turn maintains power unit 17 in its energized state with plunger 19 retracted. As such, the tail portion 45 of tilting latch member 42 is separated from plunger 19, and leaf spring 46 maintains latch leg 43 in engagement with lever 47.

As previously noted, with the apparatus in the position shown in FIG. 7, safety valve $V_1$ may be opened and closed by a demand signal received by solenoid 41 from the remote thermostat. If, in this position, the pilot flame is extinguished for any reason, the remote thermocouple senses the absence of heat, and power unit 17 is deenergized. As a result, plunger 19 is immediately extended by spring 21, and engages tail portion 45 of latch member 42 as shown in FIG. 4. This causes latch leg 43 to be rotated or tilted out of engagement with lever 47, and shaft 23 thereafter moves axially upward to close valve $V_3$. At the same time, as soon as lever 47 is released by latch leg 43, spring 51 immediately moves it downwardly until end 47*c* engages closure member 28 and closes safety valve $V_1$. As described above, this movement overrides solenoid 41 whether plunger 31 is extended or retracted.

If valve 11 is in the normal operating condition shown in FIG. 7 and it is desired to turn the appliance off, knob 22 may be rotated clockwise to the "off" position. This is permitted because, in the position shown in FIG. 7, lateral extension 22*a* of knob 22 has been in channel 55 but elevated to the level of the base of channel 53. Accordingly, the knob may be fully rotated clockwise to the "off" position.

As shaft 23 and tilting latch member 42 are rotated, latch leg 43 clears the lever 47. Latch leg 44, however, is still engaged by the inner surface of bracket 48, and latch member 42 therefore remains in the upright position shown. After latch leg 43 clears lever 47, and with further rotational movement of knob 22 to the "off" position, latch leg 44 clears the edge of bracket 48, and shaft 23 is moved to its extreme upward position by spring 24. With shaft 23 in this position, pilot valve $V_3$ is closed. Since lever 47 has been released, lever end 47*c* engages closure member 28 to close valve $V_1$.

The apparatus will remain as shown in FIG. 3 until the pilot flame thermocouple cools and deenergizes power unit 17. Until that time, knob 22 cannot be depressed to reset the valve because the end of latch leg 44 abuts the upper edge of bracket 48, preventing the knob from being depressed. When the pilot flame thermocouple cools, plunger 19 of power unit 17 extends to the position shown in FIG. 4, tilting latch member 42 clockwise to the point that latch leg 44 clears bracket 48. Knob 22 can then be depressed in the "pilot" position to initiate ignition of the pilot flame Although a particular embodiment of the invention has been shown and described in detail for illustrative purposes, a variety of modifications and other embodiments which do not depart from the applicant's teachings will be apparent to those skilled in the relevant arts. It is not intended that legal protection be limited to the disclosed embodiment, but only by the terms of the following claims.

I claim:

1. A gas valve for a gas burning appliance, comprising:

housing means defining an inlet adapted for connection to a source of gas, a main outlet adapted for connection to a gas burning appliance and a pilot outlet adapted for connection to a pilot burner on the appliance;

pilot valve means disposed between the inlet and pilot outlet for controlling the flow of gas therebetween;

main valve means disposed between the inlet and main outlet for controlling the flow of gas therebetween;

first control means for opening and closing the main valve means in response to a control signal;

manually operated control means operatively connected to the pilot valve means and movable between a first position in which the pilot valve means is closed and a second position in which the pilot valve means is opened, said manually operated control means being biased to the first position;

second control means operatively connected to the manually operated control means for retaining the manually operated control means in the second position when a pilot flame has been established at said pilot burner and for releasing said manually operated control means for return to the first position in the absence of a pilot flame; and overriding control means operatively connected to the second control means and said main valve means for closing the main valve means in overriding relation to the first control means when said pilot valve means is closed.

2. The gas valve defined by claim 1, wherein said second control means further comprises safety means for preventing movement of said manually operated control means from the first to the second position for a predetermined period of time after the pilot flame has been extinguished.

3. The gas valve defined by claim 2, wherein:

said pilot valve means comprises a pilot valve seat and a pilot valve closure member; and said manually operated control means comprises shaft means mounted in said housing means for reciprocal movement therein, said pilot valve closure member being mounted to and movable with said shaft means.

4. The gas valve defined by claim 3, which further comprises biasing means normally urging the shaft means to said first position.

5. The gas valve defined by claim 3, wherein said overriding control means comprises lever means having a first end pivotally connected to the housing means and a remote portion engagable with the main valve means, and lever biasing means normally urging the lever means into engagement with the main valve means to effect closure thereof.

6. The gas valve defined by claim 5, wherein the second control means comprises:

mechanical latch means carried by said shaft means and movable between first and second positions, said latch means comprising a first latch member engagable with said lever means when said latch means is in its second position and said shaft means is moved from its second position to its first position, said latch means being constructed and arranged to move said lever means against said lever biasing means when said first latch member is in engagement with said lever means and as said shaft means moves from its second position toward its first position, whereby said first control means is permitted to control operation of said main valve means.

7. The gas valve defined by claim 6 in which:

latching element means mounted to said housing means is included; and said latch means further comprises a second latch member engagable with said latching element means when said latch means is in its second position and said shaft means is in its second position.

8. The gas valve defined by claim 7, wherein:

said shaft means is also mounted for rotation in said housing, said shaft means being rotatable between "off", "pilot" and "on" positions;

said latch means is pivotally connected to the shaft means for tilting movement between said first and second positions;

said first latch member is engagable with said lever means only when the shaft means is in said "pilot" and "on" positions; and said second latch member being engagable with said latching element means only when the shaft means is in said "pilot" position.

9. The gas valve defined by claim 8, wherein said first latch member and said lever means are together constructed and arranged so that said first latch member moves out of engagement with said lever means as said shaft means is rotated from the "on" to the "off" position.

10. The gas valve defined by claim 8, wherein said second latch member and said latching element means are together constructed and arranged so that said second latch member moves out of engagement with said latching element means when the shaft means is rotated from the "pilot" to the "on" or "off" positions.

11. The gas valve defined by claim 10, wherein said latching element means comprises a bracket member with a notch formed therein to receive said second latch member.

12. The gas valve defined by claim 10, wherein said safety means comprises said second latch member and said bracket member which are together constructed and arranged so that said second latch member abuttably engages said bracket member when said latch means is in its second position and said shaft means is moved from its first toward its second position, whereby movement of said shaft means is prevented and said pilot valve means is maintained in a closed position.

13. The gas valve defined by claim 8, which further comprises spring means for normally urging said latching means towards said second position, and the second position control means further comprises power unit means including a plunger reciprocally movable between extended and retracted position, said plunger being normally biased into said extended position, the power unit means being energizable by a signal indicative of a pilot flame to maintain said plunger in its retracted position, said plunger being disposed for engagement with said latching means to tilt said latching means to the first position against said spring means.

14. The gas valve defined by claim 13, wherein said plunger engages said latching means as it moves to the extended position, and said plunger in said retracted position is engaged by the latching means as said shaft means is moved from its first to its second position.

15. The gas valve defined by claim 1, wherein:

said first control means comprises a solenoid having a plunger normally biased into an extended position and energizable to retract said plunger;

said main valve means comprises a valve closure member mounted to a valve stem, said plunger and said valve stem are colinearly disposed; and spring means operatively connecting said plunger and said valve stem is provided to permit relative linear movement therebetween.

* * * * *